US006517185B1

(12) United States Patent
Aldrich

(10) Patent No.: US 6,517,185 B1
(45) Date of Patent: Feb. 11, 2003

(54) LOW FORCE INK JET PRINTHEAD CAPPING SYSTEM

(75) Inventor: Charles Stanley Aldrich, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/802,765

(22) Filed: Mar. 9, 2001

(51) Int. Cl.[7] ..... B41J 2/165
(52) U.S. Cl. ..... 347/29
(58) Field of Search ..... 347/29, 22, 30, 347/32, 33

(56) References Cited

U.S. PATENT DOCUMENTS

| | | | | |
|---|---|---|---|---|
| 4,600,931 | A | 7/1986 | Terasawa | 347/30 |
| 4,728,970 | A | 3/1988 | Terasawa | 347/30 |
| 4,825,231 | A | 4/1989 | Nozaki | 347/30 |
| 5,027,134 | A | 6/1991 | Harmon et al. | 347/29 |
| 5,055,856 | A | 10/1991 | Tomii | 347/29 |
| 5,210,550 | A | 5/1993 | Fisher et al. | 347/30 |
| 5,252,993 | A | 10/1993 | Tomii et al. | 347/29 |
| 5,426,456 | A | 6/1995 | Kuelzer et al. | 347/30 |
| 5,448,270 | A | 9/1995 | Osborne | 347/29 |
| 5,450,105 | A | 9/1995 | Dangelo | 347/30 |
| 5,455,609 | A | * 10/1995 | Gast et al. | 347/32 |
| 5,517,219 | A | 5/1996 | Uchida | 347/24 |
| 5,534,896 | A | 7/1996 | Osborne | 347/29 |
| 5,602,573 | A | 2/1997 | Waschhauser et al. | 347/33 |
| 5,621,441 | A | 4/1997 | Waschhauser et al. | 347/33 |
| 5,644,346 | A | 7/1997 | Schwiebert et al. | 347/33 |
| 5,699,092 | A | 12/1997 | Kawakami et al. | 347/30 |
| 5,712,668 | A | 1/1998 | Osborne et al. | 347/32 |
| 5,714,991 | A | 2/1998 | Osborne et al. | 347/32 |
| 5,801,725 | A | 9/1998 | Neese et al. | 347/32 |
| 5,812,157 | A | 9/1998 | Nguyen et al. | 347/32 |
| 5,867,184 | A | 2/1999 | Quintana | 347/29 |
| 5,883,645 | A | 3/1999 | Ikado et al. | 347/30 |
| 5,883,647 | A | 3/1999 | Uchida | 347/29 |
| 5,896,144 | A | 4/1999 | Kishimoto et al. | 347/30 |
| 5,898,444 | A | 4/1999 | Kobayashi et al. | 347/29 |
| 5,912,681 | A | 6/1999 | Uetaki et al. | 347/29 |
| 5,936,647 | A | 8/1999 | Rhodes et al. | 347/29 |
| 5,956,053 | A | 9/1999 | Michael | 347/29 |
| 5,984,451 | A | 11/1999 | Muraki | 347/29 |
| 6,000,780 | A | 12/1999 | Schwiebert et al. | 347/33 |
| 6,010,203 | A | 1/2000 | Muraki | 347/30 |
| 6,036,299 | A | 3/2000 | Kobayashi et al. | 347/30 |
| 6,039,432 | A | 3/2000 | Eukuoka | 347/32 |
| 6,068,364 | A | 5/2000 | Kusumi et al. | 347/29 |
| 6,074,037 | A | 6/2000 | Nakahara et al. | 347/29 |
| 6,081,282 | A | 6/2000 | Saijo | 347/29 |

FOREIGN PATENT DOCUMENTS

| | | | |
|---|---|---|---|
| DE | 199 34 426 A1 | * | 2/2001 |
| EP | 0744294 A1 | | 11/1996 |
| EP | 0844092 A2 | | 5/1998 |
| JP | 404014461 A | | 1/1992 |
| JP | 405077433 A | | 3/1993 |
| JP | 405104731 A | | 4/1993 |
| JP | 406015833 A | | 1/1994 |
| JP | 406155753 A | | 6/1994 |
| JP | 408332732 A | | 12/1996 |
| JP | 411334089 A | | 12/1999 |
| JP | 2001-030504 | * | 2/2001 |

* cited by examiner

*Primary Examiner*—Shihwen Hsieh
(74) *Attorney, Agent, or Firm*—Elizabeth C. Jacobs

(57) ABSTRACT

A printhead capping system for capping a printhead includes a printhead cap having a plurality of adjoining walls. The plurality of adjoining walls has a proximal end and a distal end. The plurality of adjoining walls defines an interior region. A lip portion is provided having a perimetrical sealing surface. The lip portion extends from the distal end of the plurality of adjoining walls in a cantilever manner in, a direction non-orthogonal to an extent of the plurality of adjoining walls. In cross-section the lip portion tapers in a direction from the distal end toward the perimetrical sealing surface.

39 Claims, 5 Drawing Sheets

LOW FORCE INK JET PRINTHEAD CAPPING SYSTEM

BACKGROUND OF THE INVENTION

1. Field of the Invention

The present invention relates to an ink jet printer, and, more particularly, to a low force ink jet printhead capping system for an ink jet printer.

2. Description of the Related Art

Ink jet printers form an image on a print medium by selectively ejecting ink from one or more of a plurality of ink jet nozzles formed in a nozzle plate of an ink jet printhead. In order to maintain the printhead at an acceptable level of performance, ink jet printers typically include a maintenance station for performing scheduled maintenance operations and for providing a sealed environment for the printhead nozzle plate during periods of non-use.

One example of a maintenance station includes a movable maintenance sled including a printhead wiper and a printhead cap. The printhead wiper includes a blade edge for engaging the printhead nozzle plate to remove waste ink and contaminants that have accumulated on the printhead nozzle plate during printing. The cap may used to provide a sealed environment around the ink jet nozzles.

The cap is typically formed as a generally rectangular structure defined by four adjoining walls that extend vertically upwardly from a base, and is made from an elastomer. Commonly, the elastomer cap is placed over the nozzle plate of the printhead to ensure a sufficiently humid environment to avoid undesirable dried ink formation that may plug ink jet nozzles. Such a cap forms a leak-free seal between the printhead nozzles and the ambient environment. Conventionally, this has been done in one of two ways: by forcing the elastomer cap into the printhead with enough force to deform the cap around its sealing lip, or by providing a spring-loaded gimbaling mechanism behind the cap to allow the lip of the cap to "float" with the printhead. The former typically requires large forces to produce sufficient deformation to ensure a reliable seal, due to manufacturing tolerances. The latter typically requires less force, but adds a significant number of parts, thus increasing the cost and complexity of the cap mechanism.

As ink jet printing technology has evolved, the size of the ink jet printheads has been decreasing, while the size of the nozzle plate and the number of ink jet nozzles in the nozzle plate has increased. As a result, the surface area on the printhead available for establishing an effective seal with the cap has diminished. Also, with the larger-sized nozzle plates and the advent of non-planar printhead topography in the regions surrounding the nozzle plate, the amount of capping force exerted by the maintenance sled has had to increase to effect the same degree of sealing.

What is needed in the art is a printhead capping system that can reduce the amount of capping force required to establish and maintain an effective seal around the printhead nozzle plate.

SUMMARY OF THE INVENTION

The present invention provides a printhead capping system that can reduce the amount of capping force required to establish and maintain an effective seal around the printhead nozzle plate.

The invention comprises, in one form thereof, a printhead capping system including a printhead cap having a plurality of adjoining walls. The plurality of adjoining walls has a proximal end and a distal end. The plurality of adjoining walls defines an interior region. A lip portion is provided having a perimetrical sealing surface. The lip portion extends from the distal end of the plurality of adjoining walls in a cantilever manner in a direction non-orthogonal to an extent of the plurality of adjoining walls. In cross-section the lip portion tapers in a direction from the distal end toward the perimetrical sealing surface.

One advantage of the capping system of the present invention is that the printhead cap includes a high compliance sealing lip, which thereby lowers the capping force required to obtain an adequate seal between the printhead and the printhead cap.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
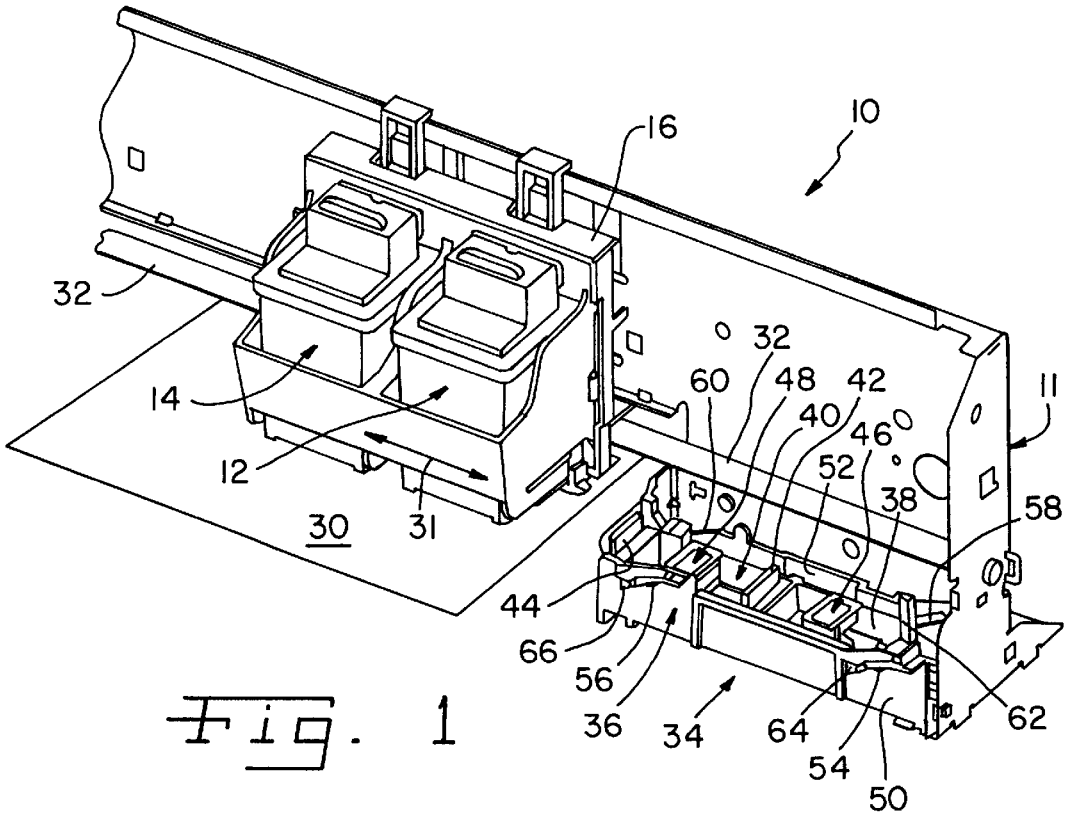
FIG. 1 is a partial perspective view of an ink jet printer embodying the present invention.

Referring to FIG. 1, there is shown a portion of an exemplary imaging apparatus in the form of an ink jet printer 10 that embodies the present invention. Ink jet printer 10 includes a frame 11 and a pair of removable ink printhead cartridges 12 and 14 supported by a printhead carrier 16. While two printhead cartridges are shown, it should be understood that the present invention may be adapted to accommodate any number of cartridges. For example, in an ink jet printer commonly referred to as a "head swapper," only one printhead cartridge is accommodated by the printer at a time, wherein a color cartridge and a black cartridge are interchanged during CMYK printing.

Figure 2:
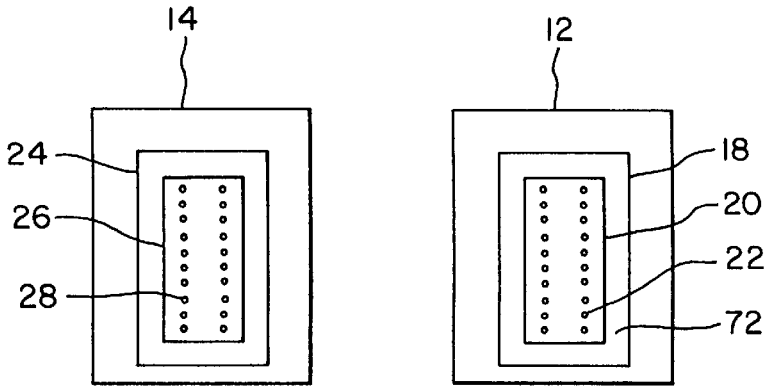
FIG. 2 is a bottom plan view of ink jet printhead cartridges used with the ink jet printer of FIG. 1.

FIG. 2 shows a bottom view of each of printhead cartridges 12 and 14. Printhead cartridge 12 includes a printhead 18 mounting an ink jet nozzle plate 20 having a plurality of ink jet nozzles 22, shown as two columns of dots. Printhead cartridge 14 includes a printhead 24 mounting an ink jet nozzle plate 26 having a plurality of ink jet nozzles 28, shown as two columns of dots. Each nozzle plate 20, 26 includes a heater chip (not shown) having a plurality of jetting actuators positioned to form a one-for-one correspondence with the plurality of ink jet nozzles 22, 28. The jetting actuators are selectively energized to expel ink from corresponding ones of ink jet nozzles 22, 28 to form an image on a media sheet 30 (see FIG. 1) in manner well known in the art. Sheet 30 may be, for example, paper, cloth or a plastic.

Carrier 16 is driven longitudinally in opposite directions, as indicated by double-headed arrow 31, in a reciprocating fashion along a guide rod 32. Guide rod 32 is supported at its opposing ends by frame 11. Carrier 16 may be driven from any suitable power source (not shown) such as, for example, a motor and gear train, or pulley and belt drive mechanism, that is coupled with carrier 16 to cause carrier 16 to slide along guide rod 32 in a reciprocating manner in response to a rotation direction of the motor, as is well known in the art.

A maintenance station 34 is provided for performing printhead maintenance operations on the ink jet nozzles 22, 28 of the printheads 18, 24, respectively. Such operations include, for example, a printhead spit maintenance operation, a printhead wiping operation and a printhead capping operation. Other services, such as for example, printhead priming and suction, may also be performed if desired, by the inclusion of a vacuum device (not shown) of the type well known in the art.

Maintenance station 34 includes a fixed support housing 36, which is attached to frame 11. A movable sled 38 is removably supported within a rectangular-shaped cavity 40 in support housing 36 and is adapted for both longitudinal and vertical movement therein. Mounted to sled 38 is a first printhead wiper 42, a second printhead wiper 44, a first printhead capping system 46 and a second printhead capping system 48.

Support housing 36 includes a first housing wall 50 and a second housing wall 52. First housing wall 50 has a pair of cam slots 54 and 56 formed therein at opposite ends thereof, and a second housing wall 52 has a cam slot 58 and an open cam surface 60 formed therein at opposite ends thereof Movable sled 38 includes a carrier engagement member 62, a first pair of pins 64 positioned symmetrically on opposite sides of sled 38 and extending therefrom, and a second pair of pins 66 positioned symmetrically on opposite sides of sled 38 and extending therefrom. Pins 64 are disposed in cam slots 54, 58, respectively, and pins 66 are disposed in cam slot 58 and on open cam surface 60, respectively. Accordingly, each of pins 64 and 66 functions as a cam follower. Cam slot 54, cam slot 56, cam slot 58 and open cam surface 60 (collectively referred to as cams 54, 56, 58, 60) control vertical motion of the movable sled 38 during the longitudinal movement of sled 38, based on the cam profile of cams 54, 56, 58, 60.

Sled 38 is spring biased in a direction toward carrier 16. As can be seen in FIG. 1 with reference to FIG. 2, a rightward movement of carrier 16 causes carrier 16 to engage carrier engagement member 62, thereby causing movable sled 38 to move to the right, and pins 64, 66 ride up the cam surface profile defined by cams 54, 56, 58, 60. When sled 38 reaches a first plateau defined by cams 54, 56, 58, 60, printhead wipers 42, 44 are positioned at a height to perform wiping maintenance on respective ones of printhead nozzle plates 20, 26. When sled 38 is moved a second plateau defined by cams 54, 56, 58, 60, printhead capping systems 46 and 48 have fully engaged the printheads 18, 24 of the ink cartridges 12 and 14, respectively, thereby providing a seal around the areas containing nozzle plates 20, 26 and the associated ink jet nozzles 22, 28, respectively. As printhead capping systems 46, 48 initially come into contact with printheads 18, 24, a capping force (Fc) is required to continue to move printhead capping systems 46 and 48 upwardly into a sealing relationship with the printheads 18, 24 of the printhead cartridges 12, 14. However, each of the printhead capping systems 46 and 48 is designed to reduce the capping force over that required to seal a printhead using a typical prior art rectangular elastomer printhead cap.

In the embodiment shown in FIG. 1, each of printhead capping systems 46 and 48 are virtually identical. Accordingly, for the sake of brevity, the following detailed discussion is directed to the structure of printhead capping system 46. However, it is to be understood that any discussion that follows relating to the structure of printhead capping system 46 would also apply to the structure of printhead capping system 48.

Figure 3A:
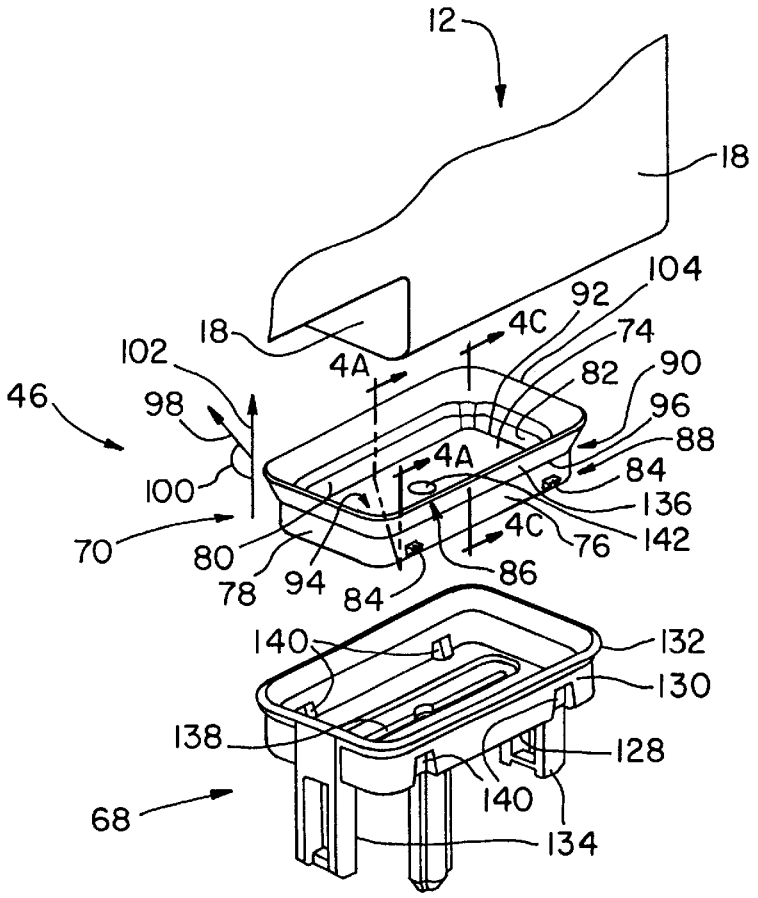
FIG. 3A is an exploded view of a first embodiment of a printhead capping system of the present invention.
Figure 3B:
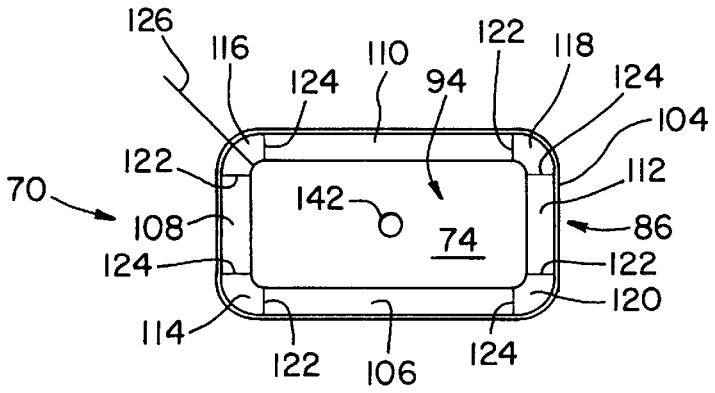
FIG. 3B is a top plan view of a printhead cap of FIG. 3A.

FIG. 3A is an exploded view of printhead capping system 46 including a cap holder 68 and low force elastomer printhead cap 70, shown in relation to printhead 18 of printhead cartridge 12. A sealing surface 72 (also shown in FIG. 4A) on printhead 18 surrounding nozzle plate 20 is shown in FIG. 2. FIG. 3B is a top plan view of printhead cap 70.

Printhead cap 70 is a unitary cup-like structure made of an elastomer material. Printhead cap 70 includes a floor portion 74, a plurality of adjoining walls 76, 78, 80 and 82, a plurality of mounting tabs referred to collectively as tabs 84, and a lip portion 86. The plurality of adjoining walls 76, 78, 80, 82 have a proximal end 88 and a distal end 90. Proximal end 88 is coupled to a perimeter 92 of floor portion 74 and distal end 90 is spaced from floor portion 74. Walls 76, 78, 80, 82 define an interior region 94.

Lip portion 86 is coupled to distal end 90 of the plurality of adjoining walls 76, 78, 80, 82. Lip portion 86 extends from the plurality of adjoining walls 76, 78, 80, 82 at a perimeter 96 in a cantilever manner in a direction, depicted by arrow 98, at an angle 100 that is non-orthogonal to a direction of an extent of the plurality of adjoining walls 76, 78, 80, 82, as depicted by arrow 102. Lip portion 86 has a perimetrical sealing surface 104.

Figure 4A:
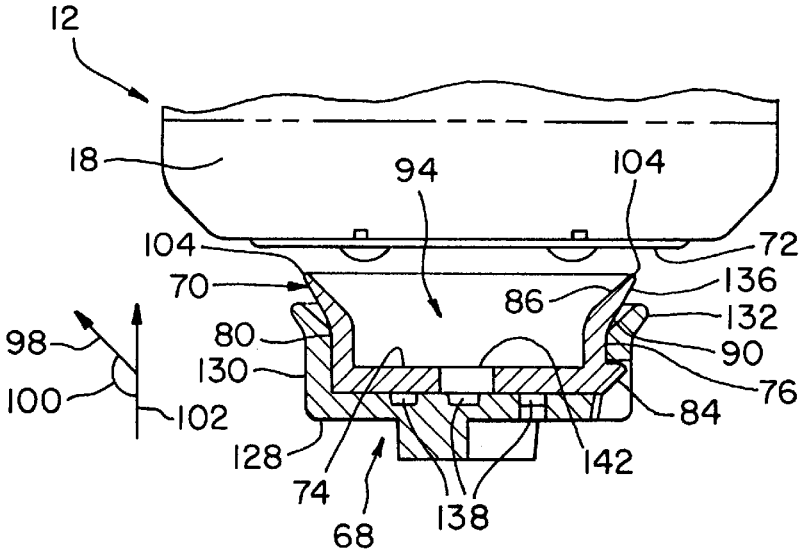
FIG. 4A is a sectional view of an assembled printhead capping system of FIG. 3A taken along line 4A—4A.
Figure 4B:
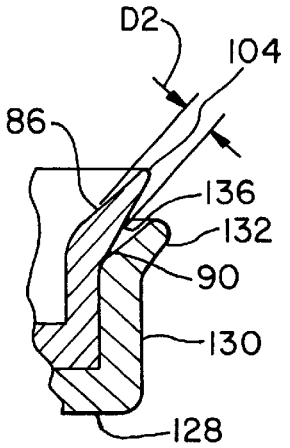
FIG. 4B is an enlargement of a portion of the sectional view of FIG. 4A depicting a cross-section of a tapered linear portion of the printhead cap.
Figure 4C:
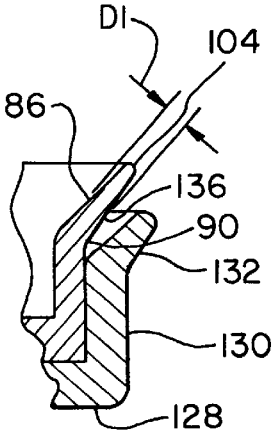
FIG. 4C is a sectional view of a corner portion of the assembled printhead capping system of FIG. 3A taken along line 4C—4C depicting a cross-section of a rounded tapered portion of the printhead cap.

FIG. 4A shows a cross-section of printhead cap 70 taken along a line 4A—4A of FIG. 3A. FIG. 4B is an enlargement of a portion of the cross-section of FIG. 4A. FIG. 4C is an enlargement of a rounded corner cross-section taken along line 4C—4C of FIG. 3A.

As shown in FIGS. 3A and 4A—4C, cantilevered lip portion 86 tapers at a shallow angle in a direction from distal end 90 of walls 76, 78, 80, 82 toward perimetrical sealing surface 104. As can be best seen in relation to FIG. 3B, lip portion 86 includes a first linear tapered portion 106, a second linear tapered portion 108, a third linear tapered portion 110 and a fourth linear tapered portion 112 arranged in a substantially rectangular configuration. A first rounded tapered portion 114 is positioned between the first and second linear tapered portions 106, 108. A second rounded tapered portion 116 is positioned between the second and third linear tapered portions 108, 110. A third rounded tapered portion 118 is positioned between the third and fourth linear tapered portions 110, 112. A fourth rounded tapered portion 120 is positioned between the first and fourth linear tapered portions 106, 112. This tapered cantilevered design advantageously gives lip portion 86 a high compliance characteristic, thereby reducing the required capping force.

Preferably, each of the first, second, third and fourth linear tapered portions 106, 108, 110, 112 has a first cross-sectional area and each of the first, second, third and fourth rounded tapered portions 114, 116, 118, 120 has a second cross-sectional area, wherein the second cross-sectional area of the rounded tapered portions 114, 116, 118, 120 is less than the first cross-sectional area of the first, second, third and fourth linear tapered portions 106, 108, 110, 112, as shown by comparison of FIG. 4B with FIG. 4C. Also, by comparison of FIG. 4B to FIG. 4C, dimension D1 of FIG. 4C is less than dimension D2 of FIG. 4B, i.e., first, second, third and fourth rounded tapered portions 114, 116, 118, 120 are thinner than first, second, third and fourth linear tapered portions 106, 108, 110, 112.

As can be best seen in FIG. 3B, each rounded tapered corner portion 114, 116, 118, 120 is defined by a first curve delimiter 122, a second curve delimiter 124 and a middle curve portion 126 located between first curve delimiter 122 and second curve delimiter 124. The second cross-sectional area of each rounded tapered corner portion 114, 116, 118, 120 thins from each of the first and second curve delimiters 122, 124 (where the first cross-sectional area ends) toward a middle curve portion, depicted by a line 126, where the cross-sectional area is the thinnest and has the smallest cross-sectional area. The purpose of making the cantilevered lip portion 86 thinner at the corners is to even the pressure exerted by the contact of perimetrical sealing surface 104 with sealing surface 72 of printhead 18.

Referring to FIGS. 3A and 4A, cap holder 68 is made of a rigid material, such as plastic, and defines a rigid structure having a base 128, a wall section 130 and a cantilever portion 132. A plurality of mounting members 134 extend away from base 128, and are used to connect cap holder 68 to sled 38. When printhead cap 70 is seated in cap holder 68, cantilever portion 132 of cap holder 68 surrounds and is spaced away from lip portion 86 of printhead cap 70. Thus, with reference to FIGS. 4A, 4B and 4C, when printhead cap 70 is not in contact with printhead 18, an outer surface 136 of lip portion 86 does not contact the rigid cantilever portion 132. However, when printhead cap 70 is in a state of compression by virtue of contact of perimetrical sealing surface 104 of printhead cap 70 with sealing surface 72 of printhead 18, outer surface 136 of lip portion 86 contacts rigid cantilever portion 132, such that cantilever portion 132 limits the amount of deflection of lip portion 86.

Referring to FIGS. 3A and 4A, base 128 of cap holder 68 defines a vent path 138 formed as a serpentine groove therein. Also, a plurality of mounting slots 140 are provided in wall section 130 near base 128. When printhead cap 70 is received into cap holder 68, tabs 84 of printhead cap 70 are received into mounting slots 140 to hold printhead cap 70 in proper relationship to cap holder 68. In addition, a vent hole 142 (see FIG. 3B) formed in printhead cap 70 is located to be in fluid communication with vent path 138 in cap holder 68. Thus, vent path 138 and vent hole 142 facilitate fluid communication of interior region 94 with the atmosphere when printhead cap 70 and printhead 18 are in sealing engagement.

While the embodiment described herein uses a tab/slot arrangement for mounting printhead cap 70 to cap holder 68, those skilled in the art will recognize that other attachment methods, such as using fasteners or adhesives, may be used to effect the attachment.

Thus, the capping system of the present invention provides a printhead cap 70 having a high compliance sealing lip portion 86, which thereby lowers the capping force (Fc) required to obtain an adequate seal between printhead 18 and printhead cap 70. Traditional cap systems typically need 150 grams to 300 grams of capping force to obtain adequate compliance and sealing of a printhead. In contrast, the capping system of the present invention permits effective sealing with about 100 grams or less of capping force. By using a thin cantilever section for sealing lip portion 86, printhead cap 70 is kept to a minimum size and does not extend outside the area of sealing surface 72 of printhead 18. This space economy allows for multiple printheads to be spaced close to one another.

Figure 5:
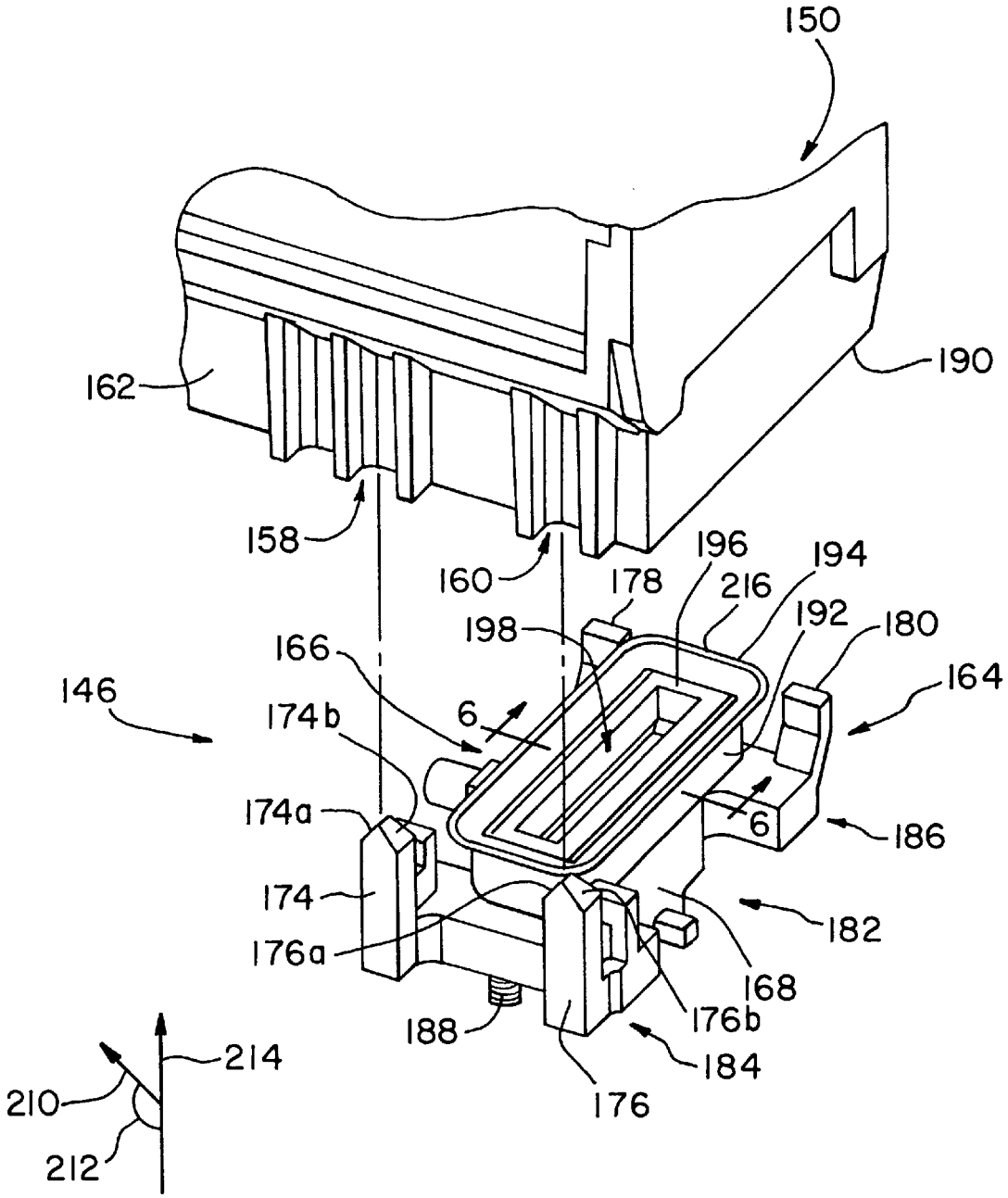
FIG. 5 is a perspective view of a second embodiment of a printhead capping system of the present invention.
Figure 6:
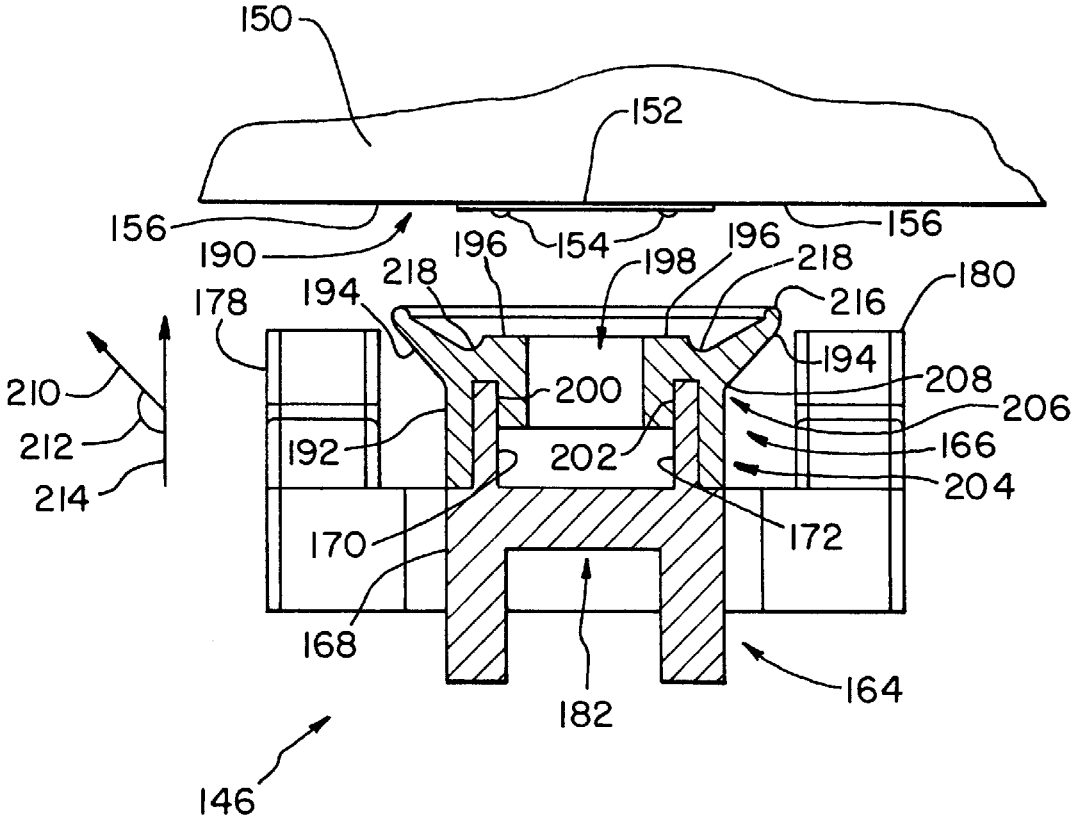
FIG. 6 is a sectional view of the printhead capping system of FIG. 5 taken along line 6—6 of FIG. 5.

FIGS. 5 and 6 are directed to a second embodiment of the present invention in which a capping system 146 is shown that is suitable for use in applying suction to a printhead 150 via a vacuum system (not shown) of ink jet printer 10.

As can be best seen in FIG. 6, a printhead 150 includes a nozzle plate 152, a plurality of standoff members 154 and a sealing region 156 that surrounds nozzle plate 152. Referring again to FIG. 5, printhead 150 includes a plurality of guide channels 158 and 160 located at an outer wall 162 of printhead 150. Guide channels 158, 160 are positioned precisely with respect to nozzle plate 152 and the allotted sealing region 156.

Printhead capping system 146 includes a cap holder 164 and a low force elastomer printhead cap 166.

Referring to FIGS. 5 and 6, cap holder 164 includes a base 168, a pair of cap mounting walls 170, 172, a pair of alignment arms 174, 176 and a pair of stop posts 178, 180. Referring to FIG. 6, cap mounting walls 170, 172 extend upwardly from a central portion 182 of base 168. As shown in FIG. 5, alignment arms 174, 176 are positioned in a spaced apart relationship and extend upwardly from a first end 184 of base 168. Alignment arm 174 includes angled surfaces 174*a* and 174*b*, and alignment arm 176 includes angled surfaces 176*a* and 176*b*. A spring 188 is provided to apply a biasing spring force midway between alignment arms 174 and 176. Stop posts 178, 180 are positioned in a spaced apart relationship and extend upwardly from a second end 186 of base 168.

Printhead cap 166 is a unitary cup-like structure made of an elastomer material. Printhead cap 166 includes a plurality of adjoining walls 192 and a lip portion 194. The plurality of adjoining walls 192 is arranged as a substantially rectangular structure. The plurality of adjoining walls 192 defines a ledge 196 adjacent an interior region 198, and a pair of mounting slots 200, 202. The plurality of adjoining walls 192 has a proximal end 204 and a distal end 206.

Referring to FIG. 6, lip portion 194 is coupled to distal end 206 of adjoining walls 192. Lip portion 194 extends from the adjoining walls 192 at a perimeter 208 in a cantilever manner in a direction depicted by arrow 210, and at an angle 212 that is non-orthogonal to a direction of an extent, depicted by arrow 214, of the plurality of adjacent walls 192. Lip portion 194 has a perimetrical sealing surface 216. Lip portion 194 has a substantially triangular cross-section that tapers at a shallow angle in a direction from distal end 206 of walls 192 toward perimetrical sealing surface 216 of lip portion 194.

Ledge 196 has an extent in the direction indicated by 214 that is less than an extent of lip portion 194 in direction 214, and a trough 218 is formed between ledge 196 and lip portion 194.

Printhead cap 166 is installed on cap holder 164 by sliding printhead cap 166 over mounting walls 170, 172 of cap holder 164, such that mounting walls 170, 172 are received in mounting slots 200, 202, respective, to form a compression fit. Alternatively, fasteners or adhesive could be used to hold printhead cap 166 to cap holder 164.

During operation, cap holder 164 is lifted by sled 38 toward engagement with printhead 150, and alignment arms 174, 176 engage guide channels 158, 160, respectively, of printhead 150. Alignment arm 174, including angled surfaces 174*a* and 174*b*, and alignment arm 176, including angled surfaces 176*a* and 176*b*, combine to provide for left to right and front to rear alignment of printhead cap 166 with printhead 150, thereby restricting at least three degrees of freedom of movement of cap holder 164 with respect to printhead 150. The terms left, right, front and rear are used in conjunction with the orientation of printhead capping system 146 and printhead 150 as shown in FIG. 5. Spring 188 is provided to aid in establishing rotational and front to rear alignment of printhead cap 166 with printhead 150. The bias spring force is applied midway between the alignment arms 174, 176. The action of this spring force keeps alignment arms 174, 176 biased against guide channels 158, 160, respectively, of printhead 150. As printhead cap 166 continues to rise, perimetrical sealing surface 216 of lip portion 194 of printhead cap 166 makes contact with sealing region 156 on printhead 150. Thereafter, lip portion 194 deflects with the application of the capping force (Fc) applied by sled 38. To prevent over-compression of printhead cap 166, stop posts 178, 180 contact the face 190 of printhead 150. Stop posts 178, 180 also prevent printhead cap 166 from cocking or tilting left to right.

The cross-sectional geometry of lip portion 194 provides for high compliance and a low capping force for a given displacement of lip portion 194. With this geometry, sealing between printhead 150 and printhead cap 166 can be achieved with the application of a capping force (Fc) of 100 grams or less. This is a significant reduction over the capping force of 150 grams to 300 grams required for capping in the prior art to accomplish a seal on an equivalent capping area.

During an ink jet nozzle priming or suctioning operation, vacuum is applied to interior region 198 of printhead cap 166. A normal high compliance cap would collapse with application of vacuum. To solve this problem, standoff members 154 of printhead 150 are provided to contact ledge 196 of printhead cap 166 with the application of vacuum to interior region 198 of printhead cap 166. This prevents the collapse of lip portion 194 and/or the interior of printhead cap 166 with the application of vacuum.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printhead capping system for capping a printhead, comprising:

a cap holder; and a printhead cap being mounted by said cap holder, said printhead cap including:

a plurality of adjoining walls having a proximal end and a distal end, said plurality of adjoining walls defining an interior region; and a lip portion having a perimetrical sealing surface, said lip portion extending from said distal end of said plurality of adjoining walls in a cantilever manner in a direction non-orthogonal to an extent of said plurality of adjoining walls, wherein in cross-section said lip portion tapers in a direction from said distal end toward said perimetrical sealing surface.

2. The printhead capping system of claim 1, wherein said lip portion has a first linear tapered portion and a first rounded tapered portion, said first linear tapered portion having a first cross-sectional area and said first rounded tapered portion having a second cross-sectional area, and wherein said second cross-sectional area is at least one of less than said first cross-sectional area and thinner than said first cross-sectional area.

3. The printhead capping system of claim 1, wherein said lip portion comprises a plurality of linear tapered portions and a plurality of rounded tapered corner portions that together define a generally polygonal shape for said perimetrical sealing surface, and wherein at least one of said plurality of linear tapered portions has a first cross-sectional area and at least one of said plurality of rounded tapered corner portions has a second cross-sectional area, and wherein said second cross-sectional area is less than said first cross-sectional area.

4. The printhead capping system of claim 3, wherein each rounded tapered corner portion is defined by a first curve delimiter, a second curve delimiter and a middle curve portion located between said first curve delimiter and said second curve delimiter, said second cross-sectional area of each rounded tapered corner portion thinning from each of said first curve delimiter and said second curve delimiter toward said middle curve portion.

5. The printhead capping system of claim 1, wherein said lip portion includes:

a first linear tapered portion, a second linear tapered portion, a third linear tapered portion and a fourth linear tapered portion arranged in a substantially rectangular configuration; and a first rounded tapered portion positioned between the first and second linear tapered portions, a second rounded tapered portion positioned between the second and third linear tapered portions, a third rounded tapered portion positioned between the third and fourth linear tapered portions and a fourth rounded tapered portion positioned between the first and fourth linear tapered portions, wherein at least one of the first, second, third and fourth linear tapered portions has a first cross-sectional area and at least one of the first, second, third and fourth rounded tapered portions has a second cross-sectional area, and wherein said second cross-sectional area is thinner than said first cross-sectional area.

6. The printhead capping system of claim 5, wherein each of said first, second, third and fourth linear tapered portions has said first cross-sectional area and each of said first, second, third and fourth rounded tapered portions has said second cross-sectional area, and wherein said second cross-sectional area is less than said first cross-sectional area.

7. The printhead capping system of claim 1, wherein said plurality of adjoining walls define a ledge adjacent said interior region, said ledge having an extent in a first direction which is less than an extent of said lip portion in said first direction, and wherein a trough is formed between said ledge and said lip portion.

8. The printhead capping system of claim 7, wherein said printhead has a plurality of standoff members extending from said printhead toward said printhead cap, wherein said standoff members contact said ledge to prevent a collapse of said printhead cap.

9. The printhead capping system of claim 1, wherein said cap holder includes a vent path formed therein, and wherein said printhead cap includes a floor portion coupled to said proximal end of said plurality of adjoining walls, said floor portion having an opening formed therein that is positioned to be in fluid communication with said vent path.

10. The printhead capping system of claim 1, wherein said cap holder defines a rigid cantilevered structure positioned around of said printhead cap for limiting an amount of deflection of said lip portion when said perimetrical sealing surface contacts said printhead.

11. The printhead capping system of claim 1, wherein said cap holder is formed from a rigid material, said cap holder defining a rigid cantilevered structure positioned around of said printhead cap, wherein when said printhead cap is not in contact with said printhead, an outer surface of said lip portion does not contact said rigid cantilever structure, and when said printhead cap is in a state of compression by virtue of contact with said printhead, said outer surface of said lip portion contacts said rigid cantilever structure to limit an amount of deflection of said lip portion.

12. The printhead capping system of claim 11, wherein said cap holder includes a vent path formed therein, and wherein said printhead cap includes an opening positioned to be in fluid communication with said vent path.

13. The printhead capping system of claim 1, wherein said cap holder includes a plurality of alignment arms for engaging a corresponding plurality of guide channels formed in said printhead for aligning said printhead cap with said printhead.

14. The printhead capping system of claim 13, wherein said plurality of alignment arms restricts at least three degrees of freedom of movement of said cap holder with respect to said printhead.

15. The printhead capping system of claim 13, wherein said cap holder includes a plurality of stop posts for engaging a face of said printhead to prevent over compression of said lip portion.

16. A printhead cap for capping a printhead, comprising:

a plurality of adjoining walls having a proximal end and a distal end, said plurality of adjoining walls defining an interior region; and a lip portion having a perimetrical sealing surface, said lip portion extending from said distal end of said plurality of adjoining walls in a cantilever manner in a direction non-orthogonal to an extent of said plurality of adjoining walls, wherein in cross-section said lip portion tapers in a direction from said distal end toward said perimetrical sealing surface.

17. The printhead cap of claim 16, wherein said lip portion has a first linear tapered portion and a first rounded tapered portion, said first linear tapered portion having a first cross-sectional area and said first rounded tapered portion having a second cross-sectional area, and wherein said second cross-sectional area is at least one of less than said first cross-sectional area and thinner than said first cross-sectional area.

18. The printhead cap of claim 16, wherein said lip portion comprises a plurality of linear tapered portions and a plurality of rounded tapered corner portions that together define a generally polygonal shape for said perimetrical sealing surface, and wherein at least one of said plurality of linear tapered portions has a first cross-sectional area and at least one of said plurality of rounded tapered corner portions has a second cross-sectional area, and wherein said second cross-sectional area is less than said first cross-sectional area.

19. The printhead cap of claim 18, wherein each rounded tapered corner portion is defined by a first curve delimiter, a second curve delimiter and a middle curve portion located between said first curve delimiter and said second curve delimiter, said second cross-sectional area of each rounded tapered corner portion thinning from each of said first curve delimiter and said second curve delimiter toward said middle curve portion.

20. The printhead cap of claim 16, wherein said lip portion includes:

a first linear tapered portion, a second linear tapered portion, a third linear tapered portion and a fourth linear tapered portion arranged in a substantially rectangular configuration; and a first rounded tapered portion positioned between the first and second linear tapered portions, a second rounded tapered portion positioned between the second and third linear tapered portions, a third rounded tapered portion positioned between the third and fourth linear tapered portions and a fourth rounded tapered portion positioned between the first and fourth linear tapered portions, wherein at least one of the first, second, third and fourth linear tapered portions has a first cross-sectional area and at least one of the first, second, third and fourth rounded tapered portions has a second cross-sectional area, and wherein said second cross-sectional area is thinner than said first cross-sectional area.

21. The printhead cap of claim 20, wherein each of said first, second, third and fourth linear tapered portions has said first cross-sectional area and each of said first, second, third and fourth rounded tapered portions has said second cross-sectional area, and wherein said second cross-sectional area is less than said first cross-sectional area.

22. The printhead cap of claim 16, wherein said plurality of adjoining walls define a ledge adjacent said interior region, said ledge having an extent in a first direction which is less than an extent of said lip portion in said first direction, and wherein a trough is formed between said ledge and said lip portion.

23. The printhead cap of claim 22, wherein said printhead has a plurality of standoff members extending from said printhead toward said printhead cap, wherein upon application of a vacuum to said interior region said standoff members contact said ledge to prevent a collapse of said printhead cap.

24. The printhead cap of claim 16, wherein said printhead cap includes a floor portion coupled to said proximal end of said plurality of adjoining walls, said floor portion having a vent opening formed therein.

25. An imaging apparatus, comprising:

a frame;

a printhead coupled to said frame for reciprocating movement in relation to said frame; and a printhead capping system coupled to said frame for capping said printhead, said printhead capping system having a cap holder and a printhead cap being mounted by said cap holder, said printhead cap including:

a plurality of adjoining walls having a proximal end and a distal end, said plurality of adjoining walls defining an interior region; and a lip portion having a perimetrical sealing surface, said lip portion extending from said distal end of said plurality of adjoining walls in a cantilever manner in a direction non-orthogonal to an extent of said plurality of adjoining walls, wherein in cross-section said lip portion tapers in a direction from said distal end toward said perimetrical sealing surface.

26. The imaging apparatus of claim 25, wherein said lip portion has a first linear tapered portion and a first rounded tapered portion, said first linear tapered portion having a first cross-sectional area and said first rounded tapered portion having a second cross-sectional area, and wherein said second cross-sectional area is at least one of less than said first cross-sectional area and thinner than said first cross-sectional area.

27. The imaging apparatus of claim 25, wherein said lip portion comprises a plurality of linear tapered portions and a plurality of rounded tapered corner portions that together define a generally polygonal shape for said perimetrical sealing surface, and wherein at least one of said plurality of linear tapered portions has a first cross-sectional area and at least one of said plurality of rounded tapered corner portions has a second cross-sectional area, and wherein said second cross-sectional area is less than said first cross-sectional area.

28. The imaging apparatus of claim 27, wherein each rounded tapered corner portion is defined by a first curve delimiter, a second curve delimiter and a middle curve portion located between said first curve delimiter and said second curve delimiter, said second cross-sectional area of each rounded tapered corner portion thinning from each of said first curve delimiter and said second curve delimiter toward said middle curve portion.

29. The imaging apparatus of claim 25, wherein said lip portion includes:

a first linear tapered portion, a second linear tapered portion, a third linear tapered portion and a fourth linear tapered portion arranged in a substantially rectangular configuration; and a first rounded tapered portion positioned between the first and second linear tapered portions, a second rounded tapered portion positioned between the second and third linear tapered portions, a third rounded tapered portion positioned between the third and fourth linear tapered portions and a fourth rounded tapered portion positioned between the first and fourth linear tapered portions, wherein at least one of the first, second, third and fourth linear tapered portions has a first cross-sectional area and at least one of the first, second, third and fourth rounded tapered portions has a second cross-sectional area, and wherein said second cross-sectional area is thinner than said first cross-sectional area.

30. The imaging apparatus of claim 29, wherein each of said first, second, third and fourth linear tapered portions has said first cross-sectional area and each of said first, second, third and fourth rounded tapered portions has said second cross-sectional area, and wherein said second cross-sectional area is less than said first cross-sectional area.

31. The imaging apparatus of claim of claim 25, wherein said plurality of adjoining walls define a ledge adjacent said interior region, said ledge having an extent in a first direction which is less than an extent of said lip portion in said first direction, and wherein a trough is formed between said ledge and said lip portion.

32. The imaging apparatus of claim 31, wherein said printhead has a plurality of standoff members extending from said printhead toward said printhead cap, wherein upon application of a vacuum to said interior region said standoff members contact said ledge to prevent a collapse of said printhead cap.

33. The imaging apparatus of claim 25, wherein said cap holder includes a vent path formed therein, and wherein said printhead cap includes a floor portion coupled to said proximal end of said plurality of adjoining walls, said floor portion having an opening formed therein that is positioned to be in fluid communication with said vent path.

34. The imaging apparatus of claim 25, wherein said cap holder defines a rigid cantilevered structure positioned around of said printhead cap for limiting an amount of deflection of said lip portion when said perimetrical sealing surface contacts said printhead.

35. The imaging apparatus of claim 25, wherein said cap holder is formed from a rigid material, said cap holder defining a rigid cantilevered structure positioned around of said printhead cap, wherein when said printhead cap is not in contact with said printhead, an outer surface of said lip portion does not contact said rigid cantilever structure, and when said printhead cap is in a state of compression by virtue of contact with said printhead, said outer surface of said lip portion contacts said rigid cantilever structure to limit an amount of deflection of said lip portion.

36. The imaging apparatus of claim 35, wherein said cap holder includes a vent path formed therein, and wherein said printhead cap includes an opening positioned to be in fluid communication with said vent path.

37. The imaging apparatus of claim 25, wherein said cap holder includes a plurality of alignment arms for engaging a corresponding plurality of guide channels formed in said printhead for aligning said printhead cap with said printhead.

38. The imaging apparatus of claim 37, wherein said plurality of alignment arms restricts at least three degrees of freedom of movement of said cap holder with respect to said printhead.

39. The imaging apparatus of claim 37, wherein said cap holder includes a plurality of stop posts for engaging a face of said printhead to prevent over compression of said lip portion.

* * * * *